US006815407B2

(12) United States Patent
Sealey

(10) Patent No.: US 6,815,407 B2
(45) Date of Patent: Nov. 9, 2004

(54) VEHICLE CLEANING FLUID

(76) Inventor: Rufus Sealey, P.O. Box 756, Arlington, GA (US) 31713

( * ) Notice: Subject to any disclaimer, the term of this patent is extended or adjusted under 35 U.S.C. 154(b) by 88 days.

(21) Appl. No.: 10/358,028

(22) Filed: Feb. 4, 2003

(65) Prior Publication Data

US 2004/0152609 A1 Aug. 5, 2004

(51) Int. Cl.[7] ..... C11D 3/22; C11D 3/00
(52) U.S. Cl. ..... 510/242; 510/372
(58) Field of Search ..... 510/242, 372, 510/375

(56) References Cited

U.S. PATENT DOCUMENTS

| | | | | |
|---|---|---|---|---|
| 2,747,734 A | | 5/1956 | Rose et al. | |
| 4,079,015 A | | 3/1978 | Paucot et al. | |
| 4,164,477 A | | 8/1979 | Whitley | |
| 4,470,919 A | | 9/1984 | Goffinet et al. | |
| 5,271,860 A | | 12/1993 | Schwadtke et al. | |
| 5,670,468 A | | 9/1997 | Moens | |
| 5,891,392 A | * | 4/1999 | Monticello et al. | 422/28 |
| 5,944,912 A | | 8/1999 | Jenkins et al. | |
| 5,990,065 A | * | 11/1999 | Vinson et al. | 510/237 |
| 6,069,122 A | * | 5/2000 | Vinson et al. | 510/235 |
| 6,106,774 A | | 8/2000 | Monticello et al. | |
| 6,113,654 A | | 9/2000 | Peterson | |
| 6,322,748 B1 | | 11/2001 | Hutton et al. | |

* cited by examiner

*Primary Examiner*—Yogendra N. Cupta
*Assistant Examiner*—John M. Petruncio
(74) *Attorney, Agent, or Firm*—John P. Sinnott; Langdale & Vallotton, LLP

(57) ABSTRACT

A composition by volume of 50% water, 42% hydrogen peroxide in a 3% solution and about 8% "Dawn" detergent when applied to insect residues spattered on vehicle surfaces is very effective in removing these residues. The composition is particularly efficient in removing *Plecia nearctica,* or "lovebug" debris from these surfaces in a manner that does not harm the vehicle finish, is inexpensive, environmentally acceptable and safe to handle.

9 Claims, No Drawings

VEHICLE CLEANING FLUID

BACKGROUND OF THE INVENTION

This invention relates to cleaning agents and, more particularly to a fluid for removing insect debris from vehicle surfaces, and the like.

Frequently, when insects impact a vehicle, an unsightly and unsanitary residue of insect debris adheres to the vehicle's surface. Removing this debris usually is accomplished by applying a cleaning fluid to the vehicle's spattered surface and vigorously brushing or rubbing the soiled portion of the surface with a cloth. This cleaning method, however, has a number of disadvantages. For example, the cleaning fluid often is costly and, when energetically applied, can introduce a risk of damaging or otherwise marring the finish on the surface that is being cleaned. Further in this respect, even with an application of considerable manual effort, some residues, or portions of these residues, will continue to adhere to the surface in question.

Particularly troublesome in this respect is the *Plecia nearctica,* or "lovebug," that breeds in regions bordering the Gulf of Mexico. In the mating season these insects cluster in immense, hovering swarms, frequently over highways, where they become a nuisance to motorists who are compelled to drive into and through these masses of breeding insects. Apart from the aggravation of driving through these insect swarms, the spattered "lovebug" residue on the vehicle surface is uncommonly difficult to remove without damaging the automobile finish, or paint.

To provide a suitable cleanser capable of removing insect, and particularly "lovebug" residues from automotive and other vehicular surfaces, several criteria must be satisfied. For example, the cleaning substance should be inexpensive; effective without excessive brushing, mopping or other physical treatment; safe to apply; environmentally harmless; and will not damage, discolor or otherwise degrade the vehicle's finish.

Through the years, hydrogen peroxide in combination with other substances has been proposed for any number of purposes, of which cleaning, deodorizing and disinfecting surfaces are typical. Hydrogen peroxide, for instance, has been proposed for use with water, hydroxides and hypochlorites to provide a flotation agent that enables expanded vermiculite to separate from abradants and other undesirable matter entrained in the exfoliated vermiculite.

With respect to cleaning fluids, proposals have been advanced to combine an organic solvent and an emulsifying agent with hydrogen peroxide and water for cleaning carpets and similar household uses.

None of these cleaning fluids that characterize the prior art, however, directly address the problem of bug residue removal or suggest a combination of materials that satisfy each of the criteria of a truly successful vehicular cleansing agent that are mentioned above. Further in this regard, these proposed cleansing formulations require a combination of not less than two substances beyond a basic water and hydrogen peroxide mixture. Clearly, these additives increase the cost of the product and are not at all effective in removing "lovebug" residues from automobiles.

DESCRIPTION OF THE INVENTION

The inadequacies of prior art cleansers in removing "lovebug" and other insect residues from vehicular surfaces are overcome, to a large extent through the practice of the invention.

Illustratively it has been found that an inexpensive mixture of 12 ounces of hydrogen peroxide (in a 3% commercial solution) with 2 ounces of a biodegradable phosphate-free anionic and nonionic surfactant, (preferably "Dawn," the trademark for a commercial cleansing fluid distributed by Proctor & Gamble, Cincinnati, Ohio 45202 under one or more of U.S. Pat. Nos. 5,990,065; 6,069,122 and D-382, 479), with 10 ounces of ordinary tap water, when applied as a liquid or as a spray to the surface of a vehicle soiled with "lovebug" residue enables all of the debris to be wiped from the surface with minimal: manual effort.

Stated more broadly, a mixture, by volume of approximately 50% water; 42% hydrogen peroxide (in a 3% solution); and about 8% "Dawn," or other suitable biodegradable anionic and nonionic surfactant (and no phosphate) produces strikingly good results in comparison with other, more complex chemical formulations.

This combination that characterizes the invention, moreover, does not damage the underlying vehicular surface finish and is no more harmful to the person applying the mixture, or to the environment, than the biodegradable surfactant in the overall mixture.

Consequently, in accordance with a salient feature of the invention, and in order to provide a superior insect debris cleanser, it has been found that adding costly combinations of substances to the basic hydrogen peroxide and water combination that have been suggested for use in prior art cleansers, e.g. compounds that combine organic solvents and emulsifying agents, with surfactants actually retard or impede insect (and particularly "lovebug") residue removal.

As a result, another important feature of the invention is the elimination of these patently less-than-inoperative additives from the cleaning agent that constitutes the invention.

Clearly, it is possible to adjust the volume proportions described above for the cleaning agent to a limited extent and still produce a useful and efficient cleaning agent within the scope of the invention. Further in this respect, the cleaning agent can be applied to a surface as either as a spray from, for example, an aerosol can.

Thus, in accordance with the invention, a cleaning agent for removing insect debris from vehicular surfaces is provided that is inexpensive; removes the insect residue without an excessive application of manual effort; is safe to apply; environmentally harmless; and does not ruin the finish on the automobile surface that is being cleaned.

What is claimed is:

1. A composition for removing insect residue from a vehicle surface consisting of a volume mixture of about 50% water; approximately 42% hydrogen peroxide in a 3% solution, and about 8% biodegradable anionic and nonionic surfactants.

2. A substance according to claim 1 wherein the composition is phosphate free.

3. A substance according to claim 1 wherein the substance consists of a liquid.

4. A substance according to claim 1 wherein the substance consists of a spray.

5. A method for removing insect debris from a vehicle surface consisting of the steps of mixing about 42% by volume of hydrogen peroxide in a 3% solution with 50% by volume of water, mixing about 8% by volume of a biodegradable anionic and nonionic surfactants with said water and said hydrogen peroxide combination to produce a combined mixture, applying said combined mixture to the insect debris on the vehicle surface, and removing said combined mixture and the insect debris from the vehicle surface.

6. A method according to claim 5 wherein the step of mixing a cleansing fluid comprising a surfactant consists of mixing a phosphate free fluid.

7. A method according to claim 5 wherein the step of applying said combined mixture to the vehicle surface further consists of the step of applying said combined mixture as a liquid.

8. A method according to claim 5 wherein the step of applying said combined mixture to the vehicle surface further consists of the step of applying said combined mixture as a spray.

9. A method according to claim 5 wherein the step of applying said combined mixture to the vehicle surface further consists of the step of wiping said combined mixture and the insect debris from the vehicle surface.

* * * * *